United States Patent [19]

Dyer et al.

[11] 4,038,759

[45] Aug. 2, 1977

[54] HAIRDRYER

[75] Inventors: Hugh Edric Trenchard Dyer; John Richard Armstrong, both of Dorset, England

[73] Assignee: Firth Cleveland Limited, London, England

[21] Appl. No.: 416,160

[22] Filed: Nov. 15, 1973

[30] Foreign Application Priority Data

Nov. 17, 1972 United Kingdom ..... 53317/72

[51] Int. Cl.[2] ..... A45D 20/24

[52] U.S. Cl. ..... 34/99; 219/369; 219/370

[58] Field of Search ..... 34/90, 91, 239, 96–101; 219/369–372

[56] References Cited

U.S. PATENT DOCUMENTS 3,377,715 4/1968 Hubner ..... 34/99

FOREIGN PATENT DOCUMENTS 1,254,523 1/1961 France ..... 34/99

*Primary Examiner*—Kenneth W. Sprague
*Assistant Examiner*—James C. Yeung
*Attorney, Agent, or Firm*—Sughrue, Rothwell, Mion, Zinn & Macpeak

[57] ABSTRACT

A hairdryer of this invention comprises a helmet to be supported on the user's head, an electric motor driven fan unit to be supported upon the user and having a casing with two outlets, and tube means connecting the casing to the helmet for flow of air from each of the two outlets of the fan unit to the interior of the helmet at the corresponding side of the user's head.

17 Claims, 11 Drawing Figures

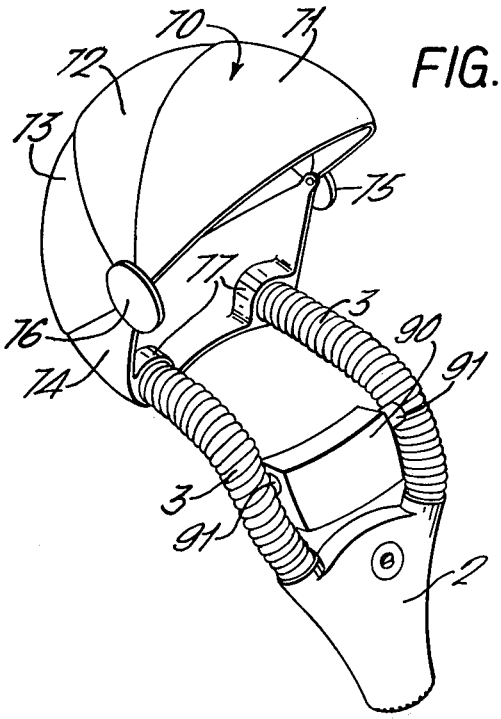
FIG. 7.
FIG. 8.
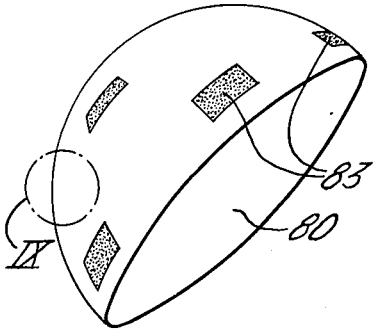
FIG. 9.
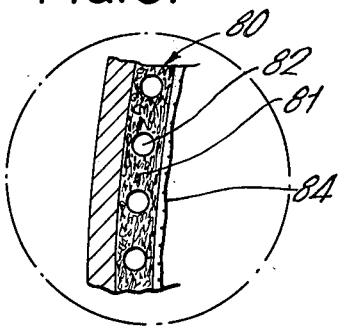
FIG. 10.
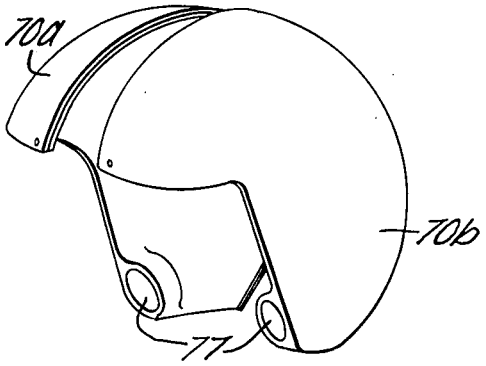

HAIRDRYER

This invention relates to hairdryers.

Hairdryers of the helmet type comprise a helmet to fit over the head, and a fan which supplies air to the interior of the helmet through a flexible tube. In principle, such hairdryers allow the user a certin amount of mobility in contrast to the type where the user must sit under the dryer or where the dryer has to be held in the hand.

The main object of the invention is to provide an improved hairdryer of the helmet type.

The invention accordingly provides a hairdryer comprising a helmet to be supported on the user's head, an electric motor driven fan unit to be supported upon the user and having a casing with two outlets, and tube means connecting the casing to the helmet for flow of air from each of the two outlets of the fan unit to the interior of the helmet at the corresponding side of the user's head. In operation, the fan unit may either be supported by the tubes or by means of a strap connected to the fan unit and passing around the neck of the user.

Embodiments of the invention will now be described by way of example with reference to the accompanying drawings, in which.

Figure 2A:
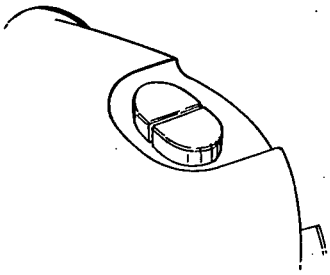
FIG. 2 is an "exploded" view of a fan unit forming part of the FIG. 1 hairdryer.
Figure 3:
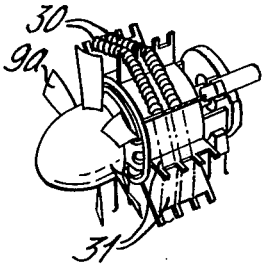
Figure 2:
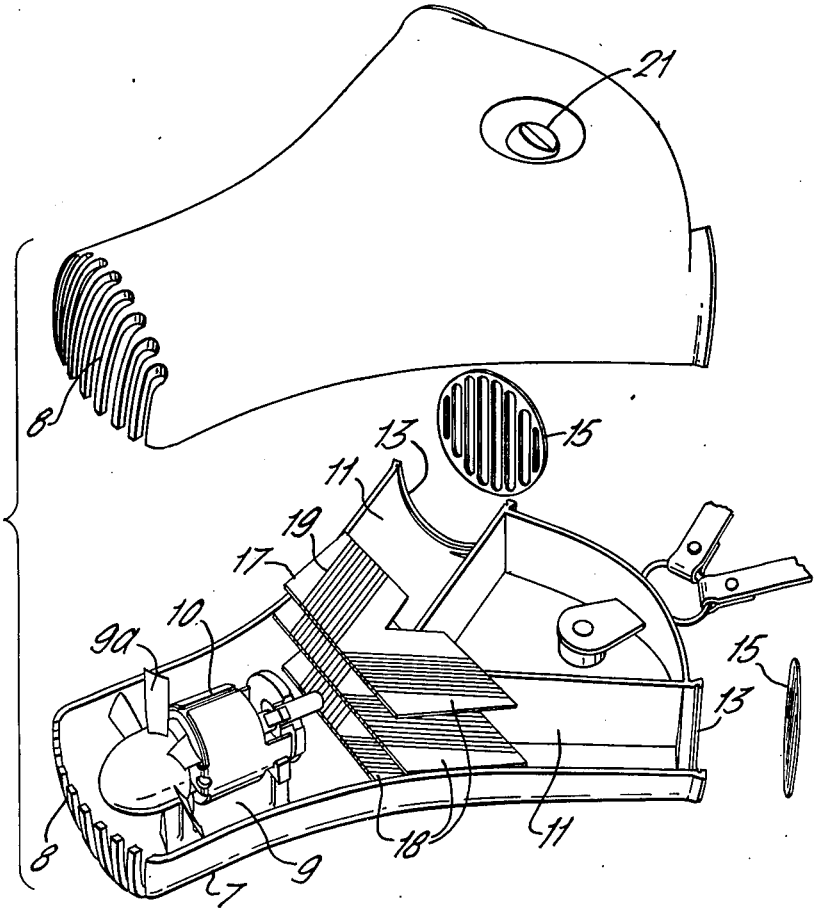
Figure 4:
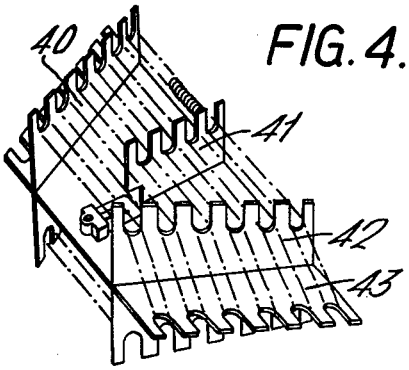
Figure 5:
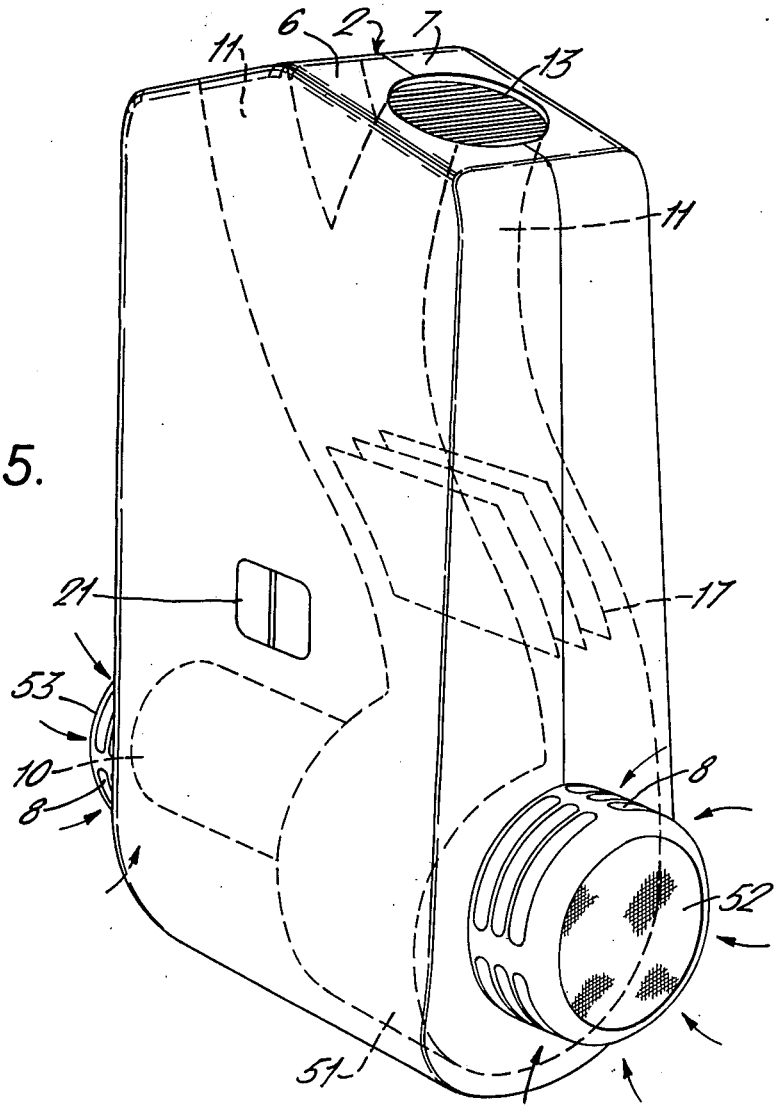
Figure 6:
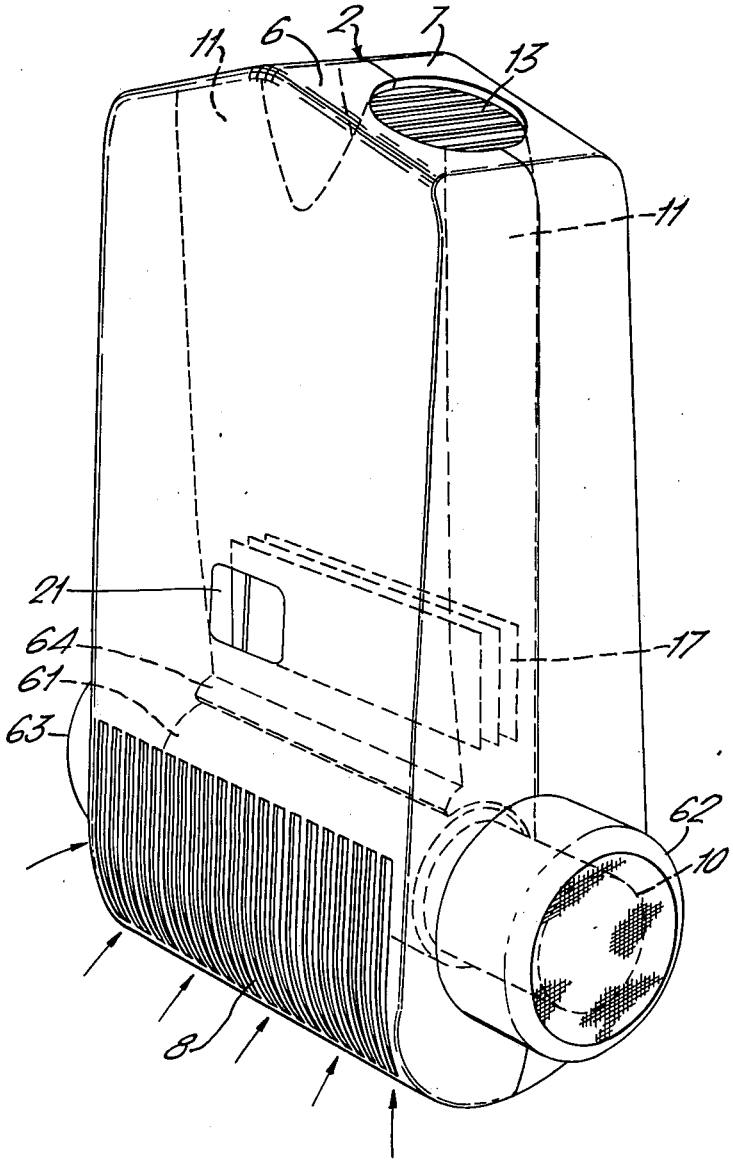

FIG. 2*a* is a partial view of a fan unit showing an alternative switch arrangement to that of FIG. 2;

FIG. 3 is a perspective view of an alternative form of fan and heating element for use in the fan unit of FIG. 2;

FIG. 4 shows yet another form of heating element;

FIGS. 5 and 6 are perspective, and somewhat diagrammatic, views of alternative forms of fan unit;

FIG. 7 is a perspective view of a second form of hairdryer of the helmet type according to the invention, shown as if in use;

FIG. 8 is a perspective view of a helmet liner which can be used in the helmet line shown in FIG. 7;

FIG. 9 is a partial cross-section of the FIG. 8 liner, and

FIG. 10 is a perspective view of an alternative form of helmet for the FIG. 7 hairdryer.

Figure 1:
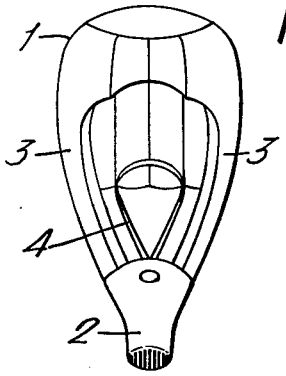
FIG. 1 is a front view of a first form of hairdryer of the helmet type according to the invention shown as if in use.

Referring to FIGS. 1 and 2 of the drawings, the hairdryer shown comprises a helmet designated generally 1, a fan unit designated generally 2 and two similar tubes 3 one either side which are integral with the helmet and connected to the fan unit so that the fan unit supplies air through each tube to the interior of the helmet and thence over the hair of the user. A neck strap 4 supports the fan unit 2 on the user; the fan unit may be positioned on the upper part of the user's chest.

The helmet 1 and tubes 3 are made of collapsible plastics material. The helmet may be made of nylon and the tubes of polyethylene, but these are only examples of many possible materials. The tubes may or may not be stiffened with a relatively flexible spiral spring. The top of the helmet can be formed in part with a double skin so as to provide inflatable pockets which help the helmet to keep its shape in use.

Projections e.g. pads of soft or semi-rigid material within the helmet may be provided to help keep the helmet clear of the user's head for proper circulation of air.

The tubes 3 themselves support the fan unit, so that the neck strap can be dispensed with. A strap may also be passed through the tubes and helmet and attached to the tubes generally in the region where these are attached to the fan unit; this would give extra support if the neck strap is not used.

The fan unit 2 comprises a generally Y shaped plastics casing formed in two parts, 6, 7. That part of the casing which forms the stem of the Y has its end formed as a grille 8 and defines a central chamber 9 which contains a fan; that depicted in the drawing numbered 9*a* is of the axial flow type. The fan is mounted at one end of the shaft of a miniature D.C. permanent magnet motor 10. Motor voltages between 6 and 24 are contemplated: a motor in the 18–24 volt range is preferred. The arms of the Y provide a pair of diverging outlet ducts 11, leading from the central chamber 9 to outlets 13, protected by grilles 15. Where the central chamber 9 forks into the outlet ducts 11, a heater unit designated generally 17 is mounted comprising three parallel insulating plates 18 on which resistance wires 19 are wound. The motor 10 with the fan rotor 9*a,* the heater unit 17 and the outlet grilles 15, 16 are nested into appropriate recesses in the lower part 7 of the casing. The upper part 6 of the casing is then assembled with the lower part to hold the various elements in place. A switch 21 in the upper part 6 of the casing controls the supply of mains electricity from a lead (not shown) to the electric motor 10 and heater unit 17. The motor 10 is connected with a rectifier in series with, or across a portion of the heating element, so that the latter forms a voltage dropper to apply voltage at a fraction of the mains supply to the motor. The circuit may be as described in our British Patent No. 1,100,823, corresponding to U.S. Pat. No. 3,348,020. There may be an additional heater winding (not shown) which is independent of the motor, and which can provide additional heat when needed without affecting the motor circuit.

An alternative switch arrangement is shown in FIG. 2*a.*

FIG. 3 shows an alternative form of heating element. The element in this case is mounted around the fan motor and takes the form of circumferential coils 30 (shown only in part) on radial insulating plates 31.

FIG. 4 shows yet another form of heating element, comprising a series of insulating plates 40, 41, 42 joined by another plate 43. Plates 40 and 42 are aligned with the centre lines of the ducts 11, and plate 43 lies across the flow in a plane at right angles. An open wound spiral heating element 44 is wound around notches in the edges of the plates.

The fan units shown in FIGS. 5 and 6 are designed to use centrifugal and cross-flow fans, respectively. Parts which fulfil the same general function as those of the FIG. 2 fan unit are given the same reference numerals and will not need further description.

In the FIG. 5 fan unit, the motor 10 drives a double-ended centrifugal fan rotor (not shown) within the volute 51. Perforated bosses 52, 53 provide the air inlet grilles 8, the first leading direct to one eye of the rotor, and the second to the interior of the casing 6, 7 and thence around the motor to the other rotor eye. The bosses 52, 53 may assist in securing together the two halves 6, 7 of the casing, and the boss 52 may carry a flexibly mounted outboard bearing for the fan rotor.

The FIG. 6 fan unit has a bladed cross-flow fan rotor 61 with one end mounted on and driven by the spindle of the motor 10 which is housed within a boss 62 on one side of the casing 6, 7. The other end of the rotor 61 is flexibly mounted on an end bearing (not shown) adjacent the opposite side of the casing, which carries a boss 63 similar in appearance to the boss 62. The rotor 61 co-operates with guide surfaces extending over its length (one of which is shown at 64) to induce a flow of air in through the inlet grille 8, twice through the path of the rotating blades, and thence over the heater element 17 to the outlet ducts 11.

The hairdryer illustrated in FIGS. 1 and 2 can pack into a relatively small box, since only the fan unit (of whatever type chosen) is rigid and the helmet and tubes can be almost totally collapsed. The helmet in use becomes relatively rigid under the air pressure set up by the fan and assumes a stable position on the user's head. In operation, the fan unit will present no impediment to mobility. The tubes 3 lie to either side of the face and do not interfere with vision. The switch 21 is nevertheless readily accessible.

If desired, the helmet can be provided with ear pieces for connection to a radio, record player or the like.

The hairdryer illustrated in FIGS. 1 and 2 employs a flexible helmet. In the hairdryers of FIGS. 7 to 9 the helmet 70 is rigid in use but collapsible for storage. The helmet 70 is formed as a series of four rigid plastics mouldings 71, 72, 73, 74 approximating to sectors of a sphere and pivotally interconnected on screws 75, 76 having disk-like knurled heads for easy manual manipulation with the screws 75, 76 loosened the mouldings 71, 72, 73 can be collapsed one over the other onto the rear moulding 74; in use the mouldings are extended to just overlap, and held rigidly in this position by tightening the screws. The rear moulding 74 has integrally formed corner portions 77 to which tubes 3 are connected: these tubes, and the fan unit 2 which supplies air to them, are as described with reference to FIGS. 1 and 2, or the fan units of FIGS. 6 and 7 may be substituted for the unit 2.

Optionally the helmet 70 may have a flexible humidifying liner 80 as shown in FIGS. 8 and 9, made of absorbent foam material 81 in which small rigid balls 82 e.g. of polystyrene are embedded. At the back, the liner carries pads 83 of the material known under the Trade Mark VELCRO: similar material (not shown) is fixed in corresponding positions within the helmet 70. A mesh 84 e.g. of nylon extends over the interior of the liner. Instead of the liner 80, pads of water-absorbent foam material may be detachably secured in the helmet when it is desired to increase humidity.

In use, the liner 80 may be dipped in water and wrung out so that the foam material 71 takes up moisture but is not dripping wet: the balls 82 prevent the water from being all squeezed out. The liner 80 may then be secured within the erected helmet 70 with the aid of the VELCRO pads. Instead of these pads, press studs or the like may be used.

A liner such as the liner 80 may also be used with the helmet shown in FIG. 1.

Instead of making the helmet from collapsing sectors as shown in FIG. 7, the helmet may be made in two halves 70*a,* 70*b* as shown in FIG. 10, the two halves fitting closely together in use, but when taken apart being nested together to save space. Means may be provided allowing for adjustment of the two halves relative to one another to enable the helmet to accommodate different sizes of head and hair style.

FIG. 7 shows a "steam" generator, 90, which can be used either with the hairdryer shown in that figure, or with hairdryer of FIG. 1. The "steam" generator is a small container for water supported between the tubes 3, or by means of a separate strap not shown. A filler plug (not shown) allows the water to be replenished. An electric heater element set to cut out at, say, 90° C. is provided to heat the water so that water vapour passes through T junctions 91 into the tubes 3. to be carried with the warm air streams into the helmet. Instead of the generator shown, a reservoir may communicate with the tubes by capillary action using a wick.

It will be appreciated that various permutations and combinations may be made of the material described, within the scope of the invention defined by the claims.

What is claimed is:

1. A hairdryer apparatus comprising:

a. a collapsible helmet having a head portion to be supported on the user's head, said head portion having a double skin section for inflation by drying air flow so as to help maintain the helmet erect;

b. an electric fan-heater unit;

c. a pair of tubes connecting the helmet head portion to the fan-heater unit to lead drying air flow from the fan-heater unit to the head portion, said pair of tubes being capable of supporting the fan-heater unit from the helmet head portion with the fan-heater unit in the region of the user's chest; and d. means to discharge heated air emanating from the fan-heater unit to the head of the user.

2. Apparatus as claimed in claim 1 wherein a strap is connected to the fan-heater unit for location about the neck of a user to assist in supporting the fan-heater unit.

3. Apparatus as claimed in claim 1 wherein the fan-heater unit has two outlets and each tube is connected to one of the two outlets.

4. A hairdryer as claimed in claim 1, wherein the fan-heater unit includes an axial fan arranged whereby in use of fan blows upward into the pair of tubes.

5. A hairdryer as claimed in claim 1, wherein the fan unit includes a centrifugal fan arranged whereby in use the fan axis is horizontal and the fan blows upwardly into a forked outlet duct.

6. A hairdryer as claimed in claim 1 wherein the fan unit includes a cross flow fan arranged whereby in use the fan axis is horizontal and the fan blows upwardly into a forked outlet duct.

7. A hairdryer as claimed in claim 1, having means to increase the humidity of the air in the collapsible helmet.

8. A hairdryer as claimed in claim 7, wherein the humidity increasing means comprises at least one foam pad removably located in the helmet.

9. A hairdryer as claimed in claim 7, wherein the humidity increasing means is a liner of flexible water absorbent material removably located within the helmet.

10. A hairdryer as claimed in claim 9, wherein the liner is of foam material with small rigid balls within the material to limit the extent to which it can be squeezed out.

11. A hairdryer as claimed in claim 7, wherein the humidity increasing means is a generator of water vapour arranged to introduce warm humidified air into the air in the pair of tubes on its way to the helmet.

12. A hairdryer as claimed in claim 11, wherein the generator comprises a water container with an electric immersion heater.

13. A hairdryer as claimed in claim 11, wherein the generator comprises a water container with wick means leading to the pair of tubes for supplying moisture by capillary action.

14. A hairdryer as claimed in claim 7, wherein the fan-heater unit has a casing providing a generally Y-shaped interior space with the fan in the leg of the Y, the pair of tubes connected to the arms of the Y, and the heater lying between the fan and the pair of tubes.

15. Hairdryer appratus comprising:

a. A collapsible helmet having a head portion to be supported on the user's head, said head portion having a double skin section for inflation by the air flow so as to help maintain the helmet erect;

b. an electric fan-heater unit including a casing with inlet means and two outlets, an electric motor driven fan in the casing to drive air from the inlet means to each outlet, electric heater means in the path of air from the fan to the outlets;

c. a pair of tubes connecting the helmet head portion to the fan-heater unit to lead air flow from the unit to the head portion, each tube having one end connected to the fan-heater unit casing about a respective outlet, said tubes being capable alone of supporting the fan-heater unit from the helmet head potion with the unit in the region of the user's chest, d. a strap connected to the fan unit for location about the neck of a user to provide alternative support for the fan unit, and e. means to discharge heated air emanating from the fan-heater unit to the head of the user.

16. In a hair dryer, a combination comprising a flexible bonnet-like hood having a double-walled main portion having an interior adapted to receive the head of a user so that said main portion covers the hair of a user, and a pair of flexible lateral hollow lobes adapted to cover the sides of the head of a user, said lobes depending from respective lateral sides of said main portion and being formed with inlet portions which are remote from said main portion and communicate said hollow lobes with a space formed between the double walls of said main portion; first means depending from and supported by both of the lobes, for supplying a stream of air to said lobes, said first means having an outlet for said stream; the weight of said first means which acts upon both of said lobes serving to stabilize the position of said hood on the head of a user without requiring any separate means for retaining the hood on the head of a user.

17. A hairdryer of the helmet type which is simple and compact in construction and which allows freedom of movement of the user, comprising in combination; a collapsible helmet, the top of the helmet formed with a double skin so as to provide inflatable pockets which help the helmet keep its shape in use, a pair of similar flexible tubes integral with the helmet and depending from each side of the helmet, a portable electric motor driven fan heater unit connected to, supported by and communicating with the tubes so that air pressure set up by the fan causes the helmet to become relatively rigid under such air pressure and assume a stable position on a user's head, the tubes positioned and shaped to lie on either side of a face of the user so as to not interfere with the user's vision.

* * * * *